US010716330B2

(12) United States Patent
Rehders

(10) Patent No.: US 10,716,330 B2
(45) Date of Patent: Jul. 21, 2020

(54) CAPSULE FOR USE WITH AN ELECTRONIC SMOKING DEVICE

(71) Applicant: FONTEM HOLDINGS 1 B.V., Amsterdam (NL)

(72) Inventor: Thorben Rehders, Hamburg (DE)

(73) Assignee: FONTEM HOLDINGS 1 B.V., Amsterdam (NL)

( * ) Notice: Subject to any disclaimer, the term of this patent is extended or adjusted under 35 U.S.C. 154(b) by 911 days.

(21) Appl. No.: 15/106,524

(22) PCT Filed: Nov. 6, 2014

(86) PCT No.: PCT/EP2014/002977

§ 371 (c)(1),
(2) Date: Jun. 20, 2016

(87) PCT Pub. No.: WO2015/090490

PCT Pub. Date: Jun. 25, 2015

(65) Prior Publication Data

US 2017/0020194 A1 Jan. 26, 2017

(30) Foreign Application Priority Data

Dec. 18, 2013 (EP) ..... 13005915

(51) Int. Cl.
*A24F 47/00* (2020.01)
*A24B 15/167* (2020.01)
(Continued)

(52) U.S. Cl.
CPC ..... *A24F 47/008* (2013.01); *A24B 15/167* (2016.11); *B65D 1/40* (2013.01); *B65D 47/36* (2013.01)

(58) Field of Classification Search
CPC ..... A24B 15/167; A24F 47/008; B65D 1/40; B65D 47/36
See application file for complete search history.

(56) References Cited

U.S. PATENT DOCUMENTS 9,737,093 B2 8/2017 Hon
2006/0174901 A1* 8/2006 Karles ..... A24D 3/163 131/337
(Continued)

FOREIGN PATENT DOCUMENTS

CN 101232825 A 7/2008
CN 201123395 Y 10/2008
(Continued)

*Primary Examiner* — Dana Ross
*Assistant Examiner* — James F Sims, III
(74) *Attorney, Agent, or Firm* — Perkins Coie LLP; Kenneth H. Ohriner

(57) ABSTRACT

A capsule (6) for use with an electronic smoking device (1) is provided where liquid for atomisation by an electric atomiser is contained within a cavity enclosed by an end wall (50); a lateral wall (50); and a puncturable membrane (34). One or more grooves (54) are provided on the inner face (52) of the lateral wall (50) adjacent the cavity. When the puncturable membrane (34) is punctured the one or more grooves (54) act to provide air channels adjacent the lateral wall (50) facilitating air to pass into the cavity as the liquid leaves the cavity via the puncture in the puncturable membrane (34).

17 Claims, 2 Drawing Sheets

Figure 1:
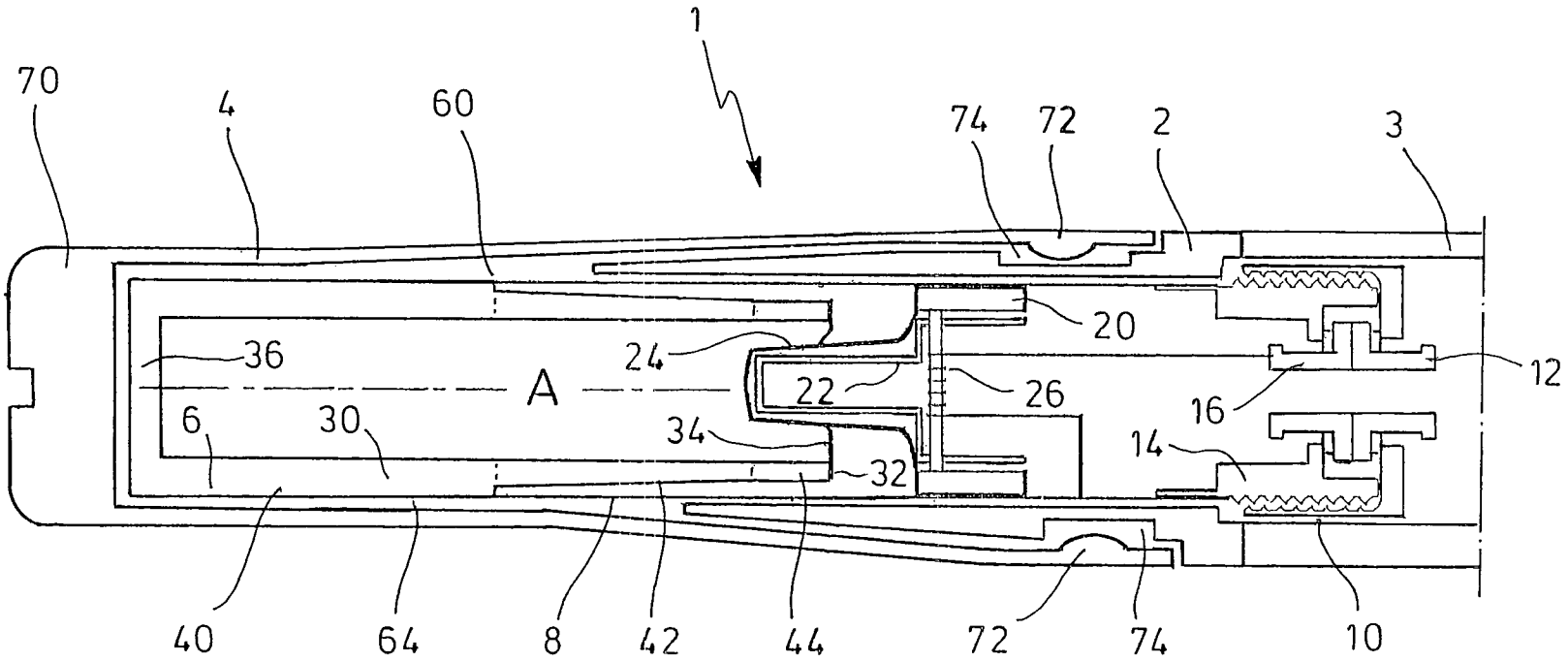

(51) Int. Cl.
*B65D 1/40* (2006.01)
*B65D 47/36* (2006.01)

(56) References Cited

U.S. PATENT DOCUMENTS

| | | | | |
|---|---|---|---|---|
| 2008/0210697 | A1* | 9/2008 | Kessell | B65D 1/40 220/666 |
| 2011/0232654 | A1* | 9/2011 | Mass | A61M 15/06 131/273 |
| 2016/0120222 | A1 | 5/2016 | Bagai et al. | |

FOREIGN PATENT DOCUMENTS

| | | | |
|---|---|---|---|
| CN | 10289448201123395 | A | 1/2013 |
| EP | 2443946 | A1 | 4/2012 |
| EP | 2489391 | A1 | 8/2012 |
| GB | 2502052 | A | 11/2013 |
| WO | 2013113174 | A1 | 8/2013 |
| WO | 2013159245 | A1 | 10/2013 |

* cited by examiner

CAPSULE FOR USE WITH AN ELECTRONIC SMOKING DEVICE

The invention relates to a capsule for use with an electronic smoking device and to a system comprising an electronic smoking device and such a capsule.

An electronic smoking device, e.g. designed as an electronic cigarette, generally comprises an elongate housing accommodating an electric power source (a battery, which often is rechargeable), an electrically activatable atomizer adapted to atomize a liquid supplied from a capsule mounted at the electronic cigarette, and control electronics, e.g. a switch (in the form of a button or a sensor which senses a user's puff) and related circuitry. Actuation of the switch (e.g. by pressing the button or upon detection of a user's puff at a mouthpiece) causes a heater in the atomizer to be powered for a certain time, thus atomizing the liquid in the atomizer area.

Here and in the following, the action of the atomizer is referred to as "atomizing" and the related product is referred to as an "aerosol", irrespective of its composition, which might include gaseous and smoke constituents.

EP 2 443 946 A1 discloses an electronic cigarette and a capsule containing a liquid to be atomized by an atomizer. The capsule comprises a shell which is sealed at one end by a puncturable membrane. To mount the capsule to the electronic cigarette, the capsule is inserted into a soft sleeve mouth piece and attached to the end of a tube accommodating the atomizer. When mounting, a spike provided at the end of a metal wick pierces the membrane, and the liquid of the capsule is guided by the wick to the atomizer. When the atomizer is activated, an aerosol is generated and the aerosol passes through some ducts provided at the exterior surface of the capsule to reach an end opening where it can be inhaled by the consumer via the mouthpiece.

An exchange of ambient air and liquid is required if the liquid contained within the capsule is to flow out of the capsule. That means, as liquid leaves the capsule, air has to enter the capsule in order to avoid a vacuum being created which would stop the flow of the liquid. Usually, a capsule comprises an injection-moulded shell made of a plastic material. The recipe of the liquid specifies parameters like the viscosity of the liquid as well as cohesive forces and adhesive forces with respect to the shell. Depending on these parameters, it is possible that liquid flow from the capsule stops if air bubbles cannot displace the liquid and no additional air enters the capsule and because of the resulting pressure conditions. In such circumstances it requires external forces to reanimate the system, e.g. by shaking, which is generally inconvenient for a user.

The object of the invention is to provide a capsule for use with an electronic smoking device, which reliably delivers liquid without flow interruptions due to problems with air exchange.

This object is achieved by a capsule for use with an electronic smoking device as defined in claim 1. Claim 14 is directed to a system comprising a related capsule and an electronic smoking device. Advantageous versions of the invention follow from the dependent claims.

A capsule according to an embodiment of the invention is adapted for use with an electronic smoking device and comprises a shell. The shell includes a lateral wall which defines a cavity for containing liquid. The cavity is enclosed at one end by open end by a puncturable membrane. When the membrane is punctured, this open end of the shell acts as an access port though which liquid contained within the shell may exit from the cavity.

According to the invention, the inner face of the lateral wall defining the cavity is provided with at least one groove.

Preferably, the capsule has a longitudinal axis, wherein the at least one groove extends generally in longitudinal direction over at least part of the length of the lateral wall.

As the inner face of the shell of the capsule is not smooth, i.e. where one or more grooves are provided in the inner surface of the shell, the surface area of the inner face of the shell is increased. The dimensions and constitution of the groove and the shell can then be such that high-viscosity liquid contained within the shell does not wet the inner face of the shell and does not fill the groove. In this way, the groove acts to form a kind of air channel which is substantially free from the liquid, which encourages the ventilation of the capsule and the exchange of liquid and air. This improves the liquid flow and facilitates continuous liquid supply. Further improved ventilation reduces the likelihood that a significant portion of liquid contained in the capsule will remain in the capsule because of problems with liquid/air exchange.

There are many possibilities for the arrangement of the at least one groove. Longitudinally arranged grooves, as already mentioned above, can guide air from the access port to the interior of the capsule in an advantageous way. A general example is a symmetric arrangement of more than one groove. Generally, the number, length, width, depth and shape of the grooves may vary. Preferably, at least three grooves are provided. Examples for cross-sections shapes of the grooves are triangular, quadrangular or substantially semi-circular. The cross-sectional shape of a groove may vary along the length of the groove. Sharp edges of a groove may be advantageous because in that case a liquid which does not wet the inner face of the shell tends to be repelled from the area of the groove in a more pronounced way. Depending on the properties of the shell material and the liquid to be contained within the shell, a person skilled in the art can design the groove or grooves provided in the inner face in an appropriate way.

When the shell of the capsule is manufactured by injection-moulding, the grooves can be provided by a specially formed core of the mould.

The effect of the grooves will depend on the properties of the material of the shell and the liquid which is to be contained in the capsule. In advantageous embodiments of the invention, the shell comprises a hydrophobic material, for example a polyolefin or PTFE, preferably polypropylene. The liquid will comprise an aerosol-generating liquid. Typically such aerosol-generating liquids are hydrophilic. They can include constituents like water and polyoles, in particular glycerol and/or propylene glycol. Typically, the liquid contains water in a range of from 0% to 20% (more preferably of from 0% to 10%, most preferably of from 2% to 7%) and polyoles, e.g. glycerol (preferably of from 0% to 70%, more preferably of from 10% to 50%, most preferably of from 15% to 25%) and/or propylene glycol (preferably of from 50% to 95%, more preferably of from 60% to 90%, most preferably of from 70% to 80%). All percentages are by weight, related to the total weight of the liquid.

The cohesive forces resulting from hydrogen bonds of the polyoles are much stronger than the adhesive forces, e.g. van der Waals forces, to the hydrophobic methyl groups of the polypropylene. Therefore, the corresponding liquid/solid surface tension results in a significant curvature of the liquid rather than in wetting the shell surface. In other words, in the neighbourhood of a groove, the liquid-does not tend to enter the groove so that the grooves are able to provide of air channels inside the capsule.

Typically, the liquid has a viscosity in the range of from 20 $mm^2/s$ to 200 $mm^2/s$, preferably of from 40 $mm^2/s$ to 100 $mm^2/s$, most preferred of from 55 $mm^2/s$ to 75 $mm^2/s$.

The shell of the capsule may comprise a step, at its outer face and along at least part of its circumference, formed by cross-sectional shapes of the shell which are different on both sides of the step. Such step can serve as a stop when the capsule is inserted in an interface provided at an electronic smoking device for mounting the capsule.

A system according to the invention comprises a capsule as explained before and an electronic smoking device. The electronic smoking device includes a housing, an electric power source (which term also covers a means for accommodating and/or connecting an electric power source like a battery or a re-chargeable battery), an electrically heatable atomizer adapted to atomize the liquid supplied from the capsule, an interface adapted to mount the capsule at the electronic smoking device, and control electronics.

In advantageous embodiments of the system, the open end of the capsule is sealed by a puncturable membrane, and the electronic smoking device comprises a wick-like conductor element having a free end provided with a piercing tip. The wick-like conductor element is adapted to direct the flow of liquid from the capsule to the atomizer, in exchange for air after the membrane of the capsule has been punctured by the piercing tip. Because of the design of the capsule, as explained above, air can enter into the interior of the capsule and is exchanged for liquid transported via the wick-like conductor element from the capsule to the atomizer. Since the air entering the capsule equalises the pressure inside the capsule, a continuous flow of liquid is maintained, mainly driven by the conditions at the atomizer which, in turn, are determined by the demand of the user. Typically, a puff detector senses a vacuum created when the user inhales at a mouthpiece of the electronic cigarette, which causes the control electronics to activate the heater of the atomizer so that the liquid in the area of the atomizer is atomized. The aerosol made in this way is inhaled by the user, and then fresh liquid is caused to flow from the capsule to the atomizer.

The electronic smoking device can be designed like a conventional electronic smoking device, e.g. as described in EP 2 443 946 A1 or WO 2013/113174 A1.

In the following, the invention is further described by means of an embodiment. The drawings show in FIG. 1 a schematic longitudinal section through an embodiment of the system according to the invention, which displays part of an electronic smoking device and a capsule mounted therein, FIG. 2 a schematic longitudinal section through the capsule, FIG. 3 a schematic longitudinal view of the shell of the capsule, FIG. 4 an end view of the shell, viewed from the open end of the shell, and FIG. 5 a three-dimensional view of the shell.

FIG. 1 illustrates an embodiment of an electronic smoking device in a schematic longitudinal section. The electronic smoking device, designated by reference numeral 1, comprises a housing which, in the embodiment, includes two sections, the section called atomizer section 2 and the section called battery section 3. An end cap 4 connected to the atomizer section 2 encloses a capsule 6 containing a liquid. The capsule 6, which will be explained in more detail by means of FIGS. 2 to 5, is held in place by a cylindrical pipe 8 extending away from the atomizer section 2 of the smoking device 1.

The battery section 3 of the housing is not shown in detail. It accommodates a rechargeable battery as an electric power source and control electronics for controlling the electronic smoking device 1, including a puff sensor detecting when a user inhales at the end cap 4, which causes the control electronics to close an electrical circuit so that an electrical current is supplied to a heatable atomizer arranged in the atomizer section 2 of the housing. For providing mechanical support and electrical contact, a female thread 10 and a pole 12 isolated therefrom are arranged in the end area of the battery section 3 shown in FIG. 1. The female thread 10 is connected to ground of the battery, the pole 12 is connected to the control electronics which serves as a switch for powering pole 12 on demand, i.e. when a puff is detected.

The end of the atomizer section 2 of the housing comprises a male thread 14 for providing connection to ground and another pole 16 which is pressed against pole 12 when the male thread 14 is threaded into the female thread 10, see FIG. 1.

In the embodiment, the atomizer comprises a cylindrical support 20 made of ceramics, which holds a bracket 22 of stainless steel. The support 20 and the bracket 22 are surrounded by an arrangement of metal filaments, e.g. a nickel wire structure, which serves as a wick 24. The interior space of the support 20 and the wick material can be heated by means of a heating wire 26 made of, e.g., a nickel chromium alloy.

The capsule 6 comprises a shell 30 having an open end 32 sealed by a puncturable membrane 34 and a closed end 36. In the embodiment, the shell 30 and the closed end 36 of the shell 30 are made in one piece by injection-moulding from polypropylene material. The membrane 34 includes an aluminium film which is heat-sealed to the shell 30. In the embodiment, an aerosol-forming liquid (see below) is contained within the cavity enclosed by the shell 30 and the puncturable membrane with the liquid freely flowing within the cavity without the cavity containing a sponge-like material like cotton for soaking up the liquid.

When the shell 30 is inserted into the pipe 8, a piercing spike mounted at the end of the bracket 22 (not shown in the figures) punctures the membrane 34 and the wick 24 enters into the interior of the capsule 6. When the wick 24 enters the interior of the capsule 6, the liquid contained in the capsule 6 is drawn by capillary action from within the capsule 6 and supplied to the atomizer, where it is caused to be distributed in the wick material about the support 20. In this way, the liquid can be easily heated by means of the heating wire 26 in order to be atomized and to form an aerosol.

Figure 2:
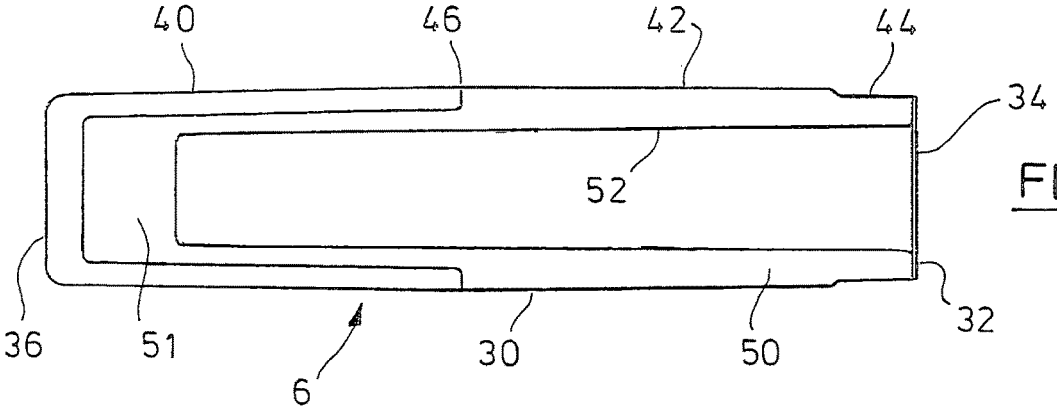

In the embodiment, the shell 30 of the capsule 6 consists of three sections, see the schematic longitudinal section shown in FIG. 2, i.e. an end section 40, which also includes the closed end 36 of the shell 30, a centre section 42, and a cylindrical section 44 adjacent to the open end 32 of the shell 30.

In its end section 40, the shell 30 in this embodiment has a triangular-like cross-sectional shape (perpendicularly to its longitudinal axis). In the centre section 42 of the shell 30, the cross-sectional shape is also substantially triangular, but somewhat different in cross section to the end section 40. In this way, some steps 46 are formed in the zone where the end section 40 meets the centre section 42. These steps 46 serve as stops, which abut at an end face of the pipe 8 when the capsule 6 is inserted into the pipe 8, see FIG. 1. In the schematic representation of FIG. 1, the triangular symmetry of the capsule 6 is not correctly displayed. This symmetry, however, is evident from FIG. 4.

Figure 3:
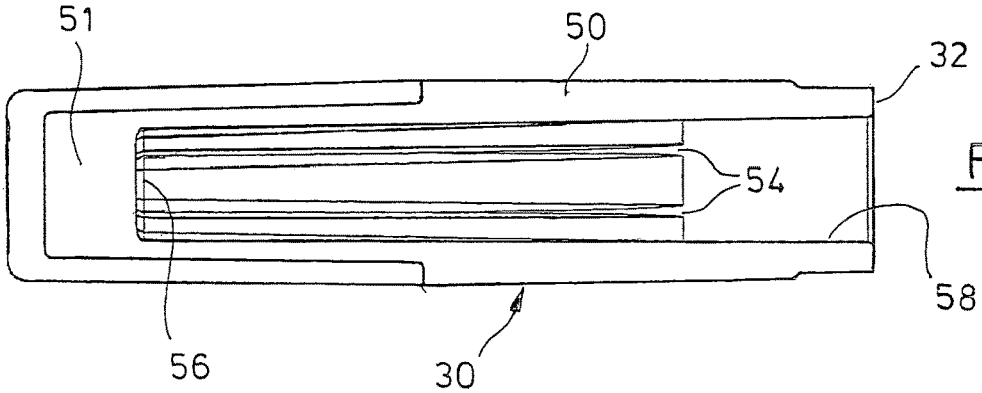
Figure 4:
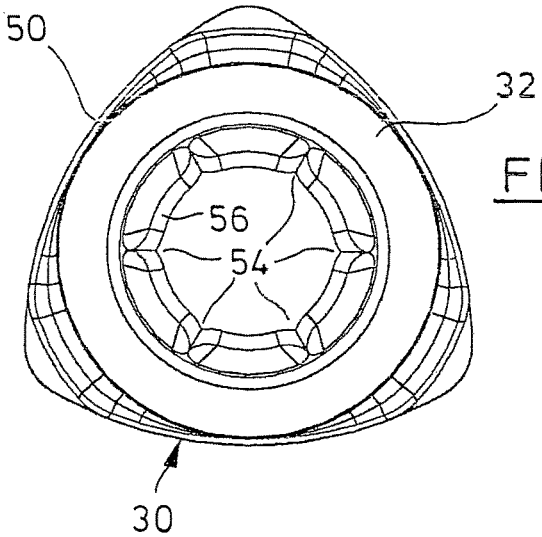
Figure 5:
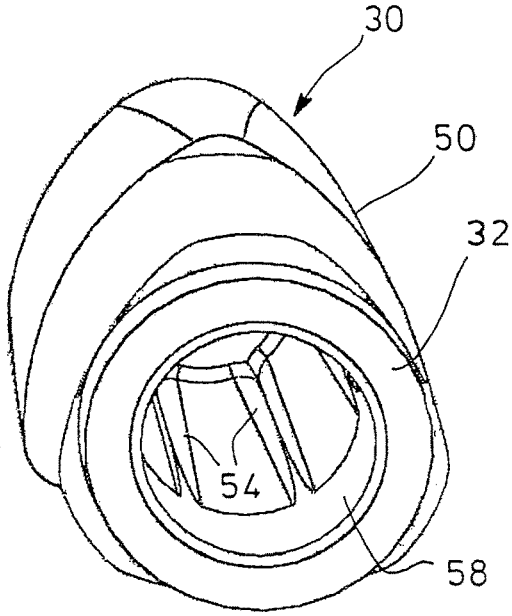

FIG. 3 shows a schematic longitudinal view of the shell 30. The shell 30 comprises a lateral wall 50 and an end wall 51 at the closed end 36. FIG. 3 also displays part the inner face (designated by 52) of the lateral wall 50. The inner face 52 is provided with longitudinally extending grooves 54. As shown in FIGS. 4 and 5, the grooves 54 (in the embodiment a total of six) are symmetrically arranged and have an essentially triangular cross-sectional shape. At the end wall 51 of shell 30, the grooves 54 are interconnected by a generally circular groove 56, also having an essentially triangular cross-sectional shape. The grooves 54 do not extend up to the open end 32 of the shell 30 so that a smooth area 58 is left in this region.

In the embodiment, the shell 30 has an outer length of about 23 mm. Preferred values for the outer length are in the range of from 20 mm to 26 mm or of from 22 mm to 24 mm. The inner diameter of the shell 30 is about 3.4 mm or somewhat smaller; it may vary. Preferred values for the inner diameter are in the range of from 2.5 mm to 4.0 mm or from 3.0 mm to 3.5 mm. The thickness of the lateral wall 50 of the shell 30 is not constant and varies between 0.8 mm to 1.6 mm. Preferred values for the thickness of the lateral wall are in the range of from 0.5 mm to 2.0 mm. The end wall 51 has a thickness comparable to that of the lateral wall 50. Generally, other dimensions of the shell 30 are conceivable as well.

Moreover, in the embodiment, the grooves 54 have a length in the range of from 10 mm to 15 mm, a depth (measured perpendicularly with respect to the lateral wall 50) in the range of from 0.2 mm to 0.5 mm, and a width in the range of from 0.3 mm to 0.5 mm. Thus, the grooves 54 extend over about 40% to 80% of the inner length of the shell 30. The depth and width of the grooves 54 may be variable along the length of a given groove 54. Generally, other dimensions of the grooves 54 are conceivable as well.

In the embodiment, the liquid in the capsule 6 contains water in a range of from 2% to 7%, glycerol in a range of from 15% to 25% and propylene glycol in a range of from 70% to 80%. The percentages are by weight, related to the total weight of the liquid. Other ingredients, like flavourants, may be contained as well. The viscosity of the liquid is in the range of from, e.g., 55 $mm^2/s$ to 75 $mm^2/s$. This liquid is hydrophilic and has a rather high viscosity.

As already mentioned, in this embodiment the shell 30 is made of a polypropylene material, which is hydrophobic. Therefore, the hydrophilic liquid in the capsule 6 does not wet the inner face 52 of the lateral wall 50. The corresponding liquid/solid surface tension results in a significant curvature of the liquid in the neighbourhood of the grooves 54, 56 so that the liquid generally does not fill the grooves 54, 56. After the membrane 34 has been pierced, the grooves serve as air channels distributing the air within the capsule 6 and facilitating a pressure relief when liquid is conducted out of the capsule 6 by means of wick 24.

In this embodiment the grooves 54, 56 do not extend into the smooth area 58 adjacent the pierced membrane 34. It is not necessary for the groove 54, 56 to extend into this area since as the smooth area is adjacent the pierced membrane 34 it is relatively easy for air to enter into this portion of the capsule 6, so that the absence of grooves in the smooth area 58 is not critical. Because of the pressure relief provided by air channels created by the grooves 54, 56, an unimpeded and continuous flow of the liquid out of the capsule 6 is largely facilitated.

When using the electronic smoking device 1, a consumer (user) removes the end cap 4 from the atomizer section 2 of the housing and inserts a fresh capsule 6 into the pipe 8 so that the spike mounted at the bracket 22 penetrates the membrane 34. In this state, the capsule 6 is secured by frictional forces between the bracket 22 (including the material of the wick 24) and the rest of the membrane 34. The wick 24 then distributes the liquid contents of the capsule 6 in the area of the atomizer so that it can be atomized when the control electronics actuates the heating wire 26. The triangular cross section of the capsule 6 compared with the circular cross section of the pipe 8 ensures that there is some free space provided inbetween the centre section 42 of the shell 30 and the inner face of the pipe 8. Another free space 64 is provided within the end cap 4, because the end cap 4 does not contact the capsule 6, see FIG. 1. Thus when the liquid within the wick 24 is atomized by the atomizer and an aerosol is generated, the aerosol can be inhaled by a user sucking on the end cap 4.

In its end area, the end cap 4 is designed as a mouthpiece 70 having a suction hole (not shown in FIG. 1). The puff detector mentioned above senses when the consumer inhales at this suction hole, which initiates the heating step described before. The end cap 4 comprises resilient protrusions 72 engaged in recesses 74 provided at the atomizer section 2 of the housing, which holds the end cap 4 in a detachable manner. When the capsule 6 is empty, the consumer can detach the end cap 4 and remove the capsule 6 from the pipe 8.

The invention claimed is:

1. An electronic smoking device, comprising:

a housing, an electric power source in the housing, an electrically heatable atomizer adapted to atomize a liquid supplied from a capsule, and an interface adapted to mount the capsule to the electronic smoking device;

the capsule comprising a shell having a closed off first end and an open second end; a puncturable membrane closing off the open second end and the liquid contained within the shell, the shell having one or more grooves on an inside surface of the shell;

wherein when the capsule is mounted to the electronic smoking device, the puncturable membrane is punctured by a liquid conductor of the electronic smoking device and the one or more grooves provide air channels allowing air to pass into the capsule as the liquid moves out of the capsule via the liquid conductor.

2. The electronic smoking device of claim 1 wherein the liquid conductor has a free end provided with a piercing tip and a wick adapted to conduct the liquid from the capsule to the atomizer after the membrane of the capsule has been punctured by the piercing tip.

3. The electronic smoking device of claim 1 with the shell having a cylindrical section adjacent to the open end of the shell.

4. The electronic smoking device of claim 1 with the shell having a smooth interior area adjacent to the open end of the shell.

5. The electronic smoking device of claim 1 having a circular groove in an end wall, the circular groove interconnecting with the one or more grooves.

6. The electronic smoking device of claim 1 wherein the shell is rigid and tubular.

7. The electronic smoking device of claim 1 wherein the one or more grooves are equally spaced apart.

8. The electronic smoking device of claim 1 having at least three grooves.

9. The electronic smoking device of claim 1 wherein one or more of the grooves has a triangular, quadrangular, and/or a semi-circular cross-sectional shape.

10. The electronic smoking device of claim 1 wherein the shell comprises a hydrophobic material.

11. The electronic smoking device of claim 1 wherein the liquid is hydrophilic.

12. The electronic smoking device of claim 1 wherein the shell comprises a step between an end section and a center section of the shell, and the shell has different cross-sectional shapes on either side of the step.

13. The electronic smoking device of claim 1 wherein the capsule has a length of 20 mm to 26 mm and an inner diameter in the range of from 2.5 mm to 4.0 mm.

14. A capsule for use with an electronic smoking device, comprising:

an elongated tubular rigid shell having a closed off first end and an open second end;

a puncturable membrane closing off the open second end;

a liquid contained within the shell;

the shell having one or more grooves extending longitudinally on an inside surface of the shell.

15. The capsule of claim 14 with the shell having a cylindrical section adjacent to the open end of the shell.

16. The capsule of claim 14 with the shell having a smooth interior area adjacent to the open end of the shell.

17. A capsule for use with an electronic smoking device, comprising:

an elongated tubular rigid shell having a closed off first end and an open second end, the shell having an outer cylindrical section adjacent to the open end of the shell, and the shell having a smooth interior area adjacent to the open end of the shell;

a puncturable membrane closing off the open second end;

a liquid contained within the shell;

the shell having one or more grooves extending longitudinally on an inside surface of the shell, between the closed off first end and the smooth interior area, the smooth interior area between the puncturable membrane and the one or more grooves.

* * * * *